US009067844B2

(12) United States Patent
Lay

(10) Patent No.: US 9,067,844 B2
(45) Date of Patent: Jun. 30, 2015

(54) DECOY COUNTERMEASURES

(71) Applicant: Chemring Countermeasures Limited, Fareham, Hampshire (GB)

(72) Inventor: Alexander Kit Lay, Fareham (GB)

(73) Assignee: Chemring Countermeasures Limited, Fareham (GB)

( * ) Notice: Subject to any disclaimer, the term of this patent is extended or adjusted under 35 U.S.C. 154(b) by 0 days.

(21) Appl. No.: 14/267,475

(22) Filed: May 1, 2014

(65) Prior Publication Data

US 2014/0373983 A1 Dec. 25, 2014

Related U.S. Application Data

(63) Continuation of application No. 12/094,260, filed as application No. PCT/GB2006/004283 on Nov. 16, 2006, now abandoned.

(30) Foreign Application Priority Data

Nov. 18, 2005 (GB) ..... 0523460.4

(51) Int. Cl.

| | |
|---|---|
| ***C06B 45/00*** | (2006.01) |
| ***D03D 23/00*** | (2006.01) |
| ***D03D 43/00*** | (2006.01) |
| ***C06C 15/00*** | (2006.01) |
| ***C06B 45/14*** | (2006.01) |

(52) U.S. Cl.

CPC ..... *C06C 15/00* (2013.01); *C06B 45/14* (2013.01)

(58) Field of Classification Search

USPC ..... 149/5, 2, 109.6

See application file for complete search history.

(56) References Cited

U.S. PATENT DOCUMENTS

| | | | | |
|---|---|---|---|---|
| 2,230,629 | A | 2/1941 | Schmid | |
| 4,799,979 | A * | 1/1989 | Baldi | 149/5 |
| 4,880,483 | A * | 11/1989 | Baldi | 149/6 |
| 4,970,114 | A * | 11/1990 | Baldi | 428/326 |
| 2003/0145924 | A1 * | 8/2003 | Carter, Jr. | 149/37 |

FOREIGN PATENT DOCUMENTS

| | | |
|---|---|---|
| DE | 19756204 | 3/1999 |
| EP | 1151817 A2 | 11/2001 |
| FR | 2712682 | 5/1995 |
| GB | 433174 | 8/1935 |

(Continued)

OTHER PUBLICATIONS

Baco-Carles, V. et al., "New method to prepare iron particles with different morphologies: a way to get high green strength metal compacts," Powder Metallurgy, vol. 45(1):33-38 (2002).

(Continued)

*Primary Examiner* — James McDonough

(74) *Attorney, Agent, or Firm* — Nelson Mullins Riley & Scarborough LLP; Anthony A. Laurentano

(57) ABSTRACT

A process of producing an infrared radiation-generating decoy for protecting against heat-seeking missiles and other heat-seeking devices comprises the step of decomposing a metal carboxy compound in the substantial absence of gaseous oxygen, to produce a pyrophoric material as a decomposition product of the metal carboxy compound, which pyrophoric material is arranged to combust spontaneously upon contact with air when the decoy is used. The metal carboxy compound may be iron oxalate, and the pyrophoric material may be ferrous oxide. The pyrophoric material may be coated onto a substrate, and a plurality of coated substrate pieces may be used in a decoy.

18 Claims, 3 Drawing Sheets

(56) References Cited

FOREIGN PATENT DOCUMENTS

Figure 1:
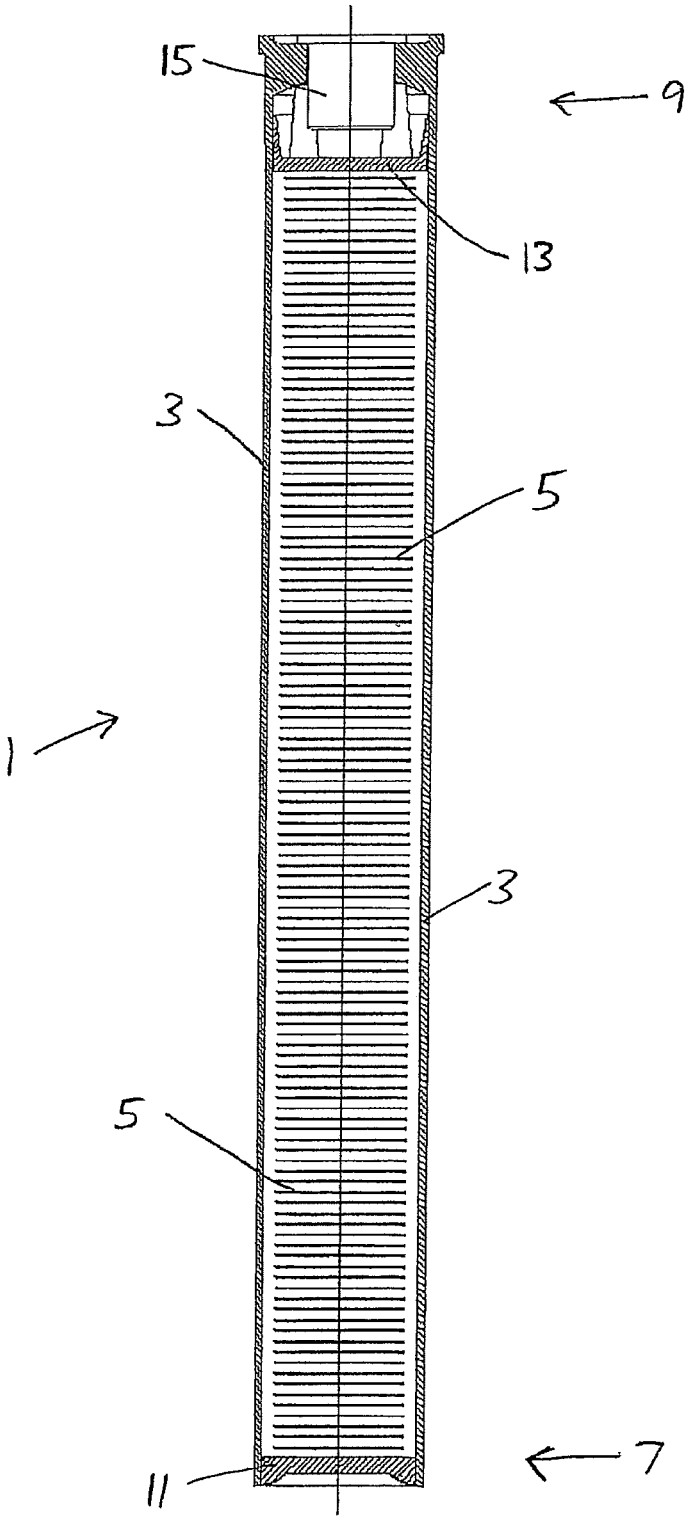

| | | |
|---|---|---|
| GB | 2191477 | 12/1987 |
| WO | 01/16258 | 3/2001 |

OTHER PUBLICATIONS

David, Robert, "The thermal decomposition of several metallic oxalates," Bulletin de la Societe Chimique de France, pp. 719-736 (1960), CAplus AC 1691:123294, Document No. 55:123294, 1 page (2008).

Li, Fashen et al., "Differential Scanning Calorimetry and Mossbauer Effect Studies of the Thermal Decomposition of Hydrous Ferrous Oxalate in Hydrogen," Phys. Stat. Sol., vol. 148:129-133 (1995).

International Search Report for Application No. PCT/GB2006/004283, 6 pages, dated Sep. 21, 2007.

* cited by examiner

DECOY COUNTERMEASURES

RELATED APPLICATIONS

This application is a Continuation of U.S. Ser. No. 12/094,260 filed on Sep. 10, 2008 in the United States, which is a 35 U.S.C. 371 national stage filing of International Application No. PCT/GB2006/004283, filed 16 Nov. 2006, which claims priority to Great Britain Patent Application No. 0523460.4 filed on 18 Nov. 2005 in Great Britain. The contents of the aforementioned applications are hereby incorporated by reference.

The present invention relates to countermeasures for protecting personnel and equipment in air, sea and land combat situations. The invention particularly relates to countermeasures, in particular decoys, for protecting against heat-seeking missiles and other heat-seeking devices.

Heat-generating decoys (commonly referred to as infrared-generating decoys) for attracting heat-seeking missiles so that they are diverted away from a target ("seduction mode" decoys), and for distracting or confusing heat-seeking missiles to prevent them Locking onto a target ("distraction mode" or "confusion mode" decoys) are well known. Such decoys commonly employ pyrotechnic materials to generate heat. However, other types of infrared-generating decoys are known, including decoys that employ pyrophoric materials. (A pyrophoric material is a material that ignites spontaneously in air; that is, it combusts spontaneously on contact with atmospheric oxygen.)

U.S. Pat. No. 4,880,483 (Alloy Surfaces Company) discloses the use of pyrophoric materials in decoys to ignite thermite-type reactions, with the thermite-type reactions generating the infrared radiation that acts as the decoy for the heat-seeking missile. This, and other patents from Alloy Surfaces Company (for example U.S. Pat. No. 4,970,114) also disclose the use of pyrophoric materials to generate the infrared radiation that acts as the decoy for the heat-seeking missile. Such pyrophoric materials comprise Raney iron or Raney nickel, i.e. elemental iron or nickel that has been "activated" by creating a micro-porous surface of the elemental iron or nickel, so that it has a large surface area for a given mass. The activation of the iron or nickel is carried out by producing an iron-aluminium or nickel-aluminium alloy, and leaching away much of the aluminium with a caustic sodium hydroxide solution.

The inventor of the present invention has devised a novel and inventive alternative.

Accordingly, a first aspect of the present invention provides a process of producing an infrared radiation-generating decoy, comprising the step of decomposing a metal carboxy compound in the substantial absence of gaseous oxygen, to produce a pyrophoric material as a decomposition product of the metal carboxy compound, which pyrophoric material is arranged to combust spontaneously upon contact with air when the decoy is used.

Preferably, the step of decomposing the metal carboxy compound comprises thermally decomposing the metal carboxy compound.

A second aspect of the invention provides a process of producing an infrared radiation-generating decoy, comprising the steps of coating a non-pyrophoric composition onto a substrate and thermally decomposing at least a component of the composition in the substantial absence of gaseous oxygen, to produce a coating of a pyrophoric material on the substrate, which pyrophoric material is arranged to combust spontaneously upon contact with air when the decoy is used.

A third aspect of the invention provides an infrared radiation-generating decoy produced by a process according to the first aspect and/or the second aspect of the invention.

The invention has the advantage that by producing the pyrophoric material for the decoy by decomposition (e.g. the thermal decomposition of a metal carboxy compound coated on a substrate), the production of the pyrophoric material can be much simpler than the known processes. In particular, it avoids the need to form an alloy of iron and aluminium (or iron and nickel) and to leach the aluminium away using sodium hydroxide, as disclosed in the US patents referred to above. Also, as described below, the material of any substrate that might be used can be chosen such that it has minimal environmental and safety impacts once the decoy has been used.

Preferably, the thermal decomposition is carried out at a temperature of greater than 200 degrees centigrade, preferably greater than 300 degrees centigrade, more preferably greater than 375 degrees centigrade, for example at approximately 400 to 450 degrees.

The metal preferably is an element from the first row of the transition elements, or a group IVb element, of the periodic table of the elements. It is particularly preferred for the metal to comprise iron, but the metal could alternatively or additionally comprise nickel, cobalt, tin or lead, for example.

By a "carboxy compound" is meant (at least in the broadest aspects of the invention) a compound containing carbon and oxygen. However, the carboxy compound preferably comprises a carboxylate (especially a dicarboxylate). A particularly preferred carboxylate is oxalate, but other carboxylates could be used in addition or instead, including (without limitation) acetate, formate, fumerate, tartrate, etc. Mixtures of carboxylates may be used, or alternatively a single carboxylate may be used. Additionally or alternatively, the carboxy compound may comprise a carbonate or a hydrogen-carbonate.

Especially preferred metal carboxylate compounds are ferrous oxalate and ferrous fumarate, and these may be used together or separately.

In some aspects of the invention, the pyrophoric material comprises the elemental metal. For example, the pyrophoric material may comprise elemental nickel, cobalt, tin or lead. Additionally or alternatively, the pyrophoric material may, at least in some aspects of the invention, comprise an oxide of the metal. It is especially preferred for the pyrophoric material to comprise ferrous oxide (Fe(II)O).

The use of pyrophoric ferrous oxide (Fe(II)O) in a decoy is believed to be novel and inventive in its own right. Accordingly, a fourth aspect of the invention provides an infrared radiation-generating decoy comprising pyrophoric ferrous oxide (Fe(II)O). Preferably, the decoy according to the fourth aspect of the invention is produced by a process according to the first and/or second aspect of the invention.

For example, for those embodiments of the invention in which the production of the decoy involves the thermal decomposition (in the absence of gaseous oxygen) of ferrous oxalate to produce pyrophoric finely divided ferrous oxide, the basic decomposition may be represented as follows:

$$Fe(II)(O_2CCO_2).2H_2O \rightarrow Fe(II)O+CO_2+CO+2H_2O$$

(The thermal decomposition of ferrous carboxy compounds is generally not an entirely "clean" reaction. FeO is a non-stoichiometric compound with an actual composition of $Fe_{1-x}O$, where: $0.05<x<0.12$. Also, FeO can disproportionate, and therefore the decomposition may result in some pyrophoric elemental Fe and/or $Fe_3O_4$.)

In particularly preferred embodiments of the invention, the decoy includes a substrate, and the pyrophoric material is coated on the substrate. Advantageously, this may be achieved by coating the metal carboxy compound on the substrate, and then decomposing (preferably thermally) the metal carboxy compound to form the pyrophoric material as a coating on the substrate. It is preferred for the substrate to be coated by painting the coating on the substrate, but substantially any coating method may be used, including dipping and/or spraying, for example. The coating preferably is dried prior to the decomposition step, for example by being heated to a temperature lower than that at which the carboxy compound decomposes, e.g. in the region of 100 degrees centigrade.

The metal carboxy compound that is coated on the substrate preferably is in particulate form, and more preferably has a median particle size (d50) of less than less than 20 μm, more preferably less than 5 μm, especially less than 3 μm.

Once the substrate has been coated, it may be cut into a plurality of smaller coated substrates (referred to herein as "leaflets"). This may be done either before or after the decomposition step that turns the coating pyrophoric, but it has been found that it is generally more convenient to cut the coated substrate into leaflets before the decomposition step (given the need to prevent the leaflets coming into contact with air once their coatings have been made pyrophoric). The decoy preferably includes a container, and the process preferably includes the steps of packing a plurality of coated substrates (leaflets) into the container in the substantial absence of gaseous oxygen, and then sealing the container against the ingress of gaseous oxygen. The decomposition step may be carried out either before or after the step of packing the leaflets into the container, but it has been found that it is generally more convenient to carry out the decomposition step with the leaflets already packed in the container. The number of leaflets used in the decoy may be chosen according to the particular requirements, and depending upon the thicknesses of the leaflets and the size and type of decoy round. The number of leaflets in a decoy may, for example, be between 50 and 5000, preferably between 60 and 3000, especially between 700 and 1500. As explained above, the decomposition step preferably is carried out by heating the coated substrates to a temperature of about 400 to 450 degrees centigrade. The length of heating time required will generally depend upon the number of leaflets present. For example, for a "stack" of 1000 leaflets, it has been found that a period of two hours at approximately 400 degrees centigrade is generally sufficient.

The decoy is advantageously provided with means for opening the container to the atmosphere when the decoy is used (deployed), thereby causing the pyrophoric material to ignite spontaneously.

The substrate preferably is combustible such that it is combusted when the decoy is used. More preferably, the substrate is substantially entirely combusted when the decoy is used. The substrate may, for example, comprise a woven or non-woven (e.g. knitted or braided) cloth, but preferably the cloth is non-woven. The cloth preferably comprises viscose/rayon (i.e. reconstituted cellulose), carbon cloth or cotton (e.g. muslin). The weight of the cloth preferably is in the range of 15-60 $gm^{-2}$, more preferably 20-45 $gm^{-2}$, e.g. 28 $gm^{-2}$, 38 $gm^{-2}$, or 40 $gm^{-2}$. For those embodiments of the invention in which the pyrophoric material is produced by thermal decomposition, the substrate generally must substantially retain its integrity at the temperatures reached during the decomposition process (e.g. up to about 450 degrees centigrade). The inventor has found that non-woven rayon cloth (and woven cotton cloth) can reliably retain its integrity when heated to such temperatures, despite being at least partially carbonised by the heating. When the decoy is used, the combustion of the pyrophoric material, and any other exothermic reactions, normally cause the rayon cloth substrate to be entirely combusted to carbon soot, thereby creating very little environmental impact, and substantially no safety hazard for aircraft. The use of cloth as the substrate also has the advantage that it has low density in comparison to other decoys, for example, and thus decoys according to the invention that utilise cloth substrates can be significantly lower in weight than other decoys. This can have tremendous benefits, especially for aircraft deployed decoys, where weight reduction is a constant aim.

The coating preferably includes a binder. The binder preferably is substantially temperature resistant at least to the temperatures at which the thermal decomposition may be carried out (e.g. up to about 450 degrees centigrade). The binder preferably also provides at least a degree of wear resistance, to prevent the pyrophoric material and/or any other active materials, from being removed from the substrate during manufacturing or subsequently. Preferred binders include silicates, phosphates and clays, for example. Most preferably, the binder comprises sodium silicate. The binder (especially when sodium silicate binder is used) preferably comprises approximately 3% by weight of the coating, but this can vary between 1% and 10% by weight of the coating, for example. The binder preferably is used as a solution in water, with the total weight of binder solution with respect to the other coating components varying depending on the desired thickness of the coating. An example of a preferred coating composition uses an equal weight of binder solution (preferably 2.7% sodium silicate in water) to the combined weight of the other coating components. A second example of a preferred coating composition uses twice the weight of a weaker binder solution (preferably 1.35% sodium silicate in water) to the weight of the other coating components. The use of water as a coating medium is an advantage as it avoids the use of volatile and environmentally unfriendly solvents.

The pyrophoric material of the decoy preferably is arranged to generate at least some of the infrared radiation emitted by the decoy, when it combusts in use.

For example, for those embodiments of the invention in which the pyrophoric material , comprises ferrous oxide, upon exposure to atmospheric oxygen the ferrous oxide undergoes an exothermic oxidation reaction to produce ferric (HI) oxide, which may be represented as follows:

$$2Fe(II)O+\tfrac{1}{2}O_2 \rightarrow Fe(III)_2O_3+\text{Heat } (1.95\ kJg^{-1})$$

In many preferred embodiments of the invention, the coating includes one or more other elements and/or compounds arranged to react exothermically when the decoy is used, thereby generating infrared radiation. The exothermic reaction or reactions may, for example, comprise a thermite-type reaction and/or an alloying reaction and/or a pyrotechnic reaction. Advantageously, the exothermic reaction or reactions of the other elements and/or compounds may be arranged to be initiated/ignited by the combustion of the pyrophoric material, in use. For example, the one or more other elements and/or compounds may comprise one or more of: aluminium, boron (preferably amorphous boron), carbon, lithium, silicon, magnesium, phosphorous, titanium, calcium, zirconium, sulphur, manganese, cerium, iron, zinc, tungsten, nickel, palladium, platinum, metal sulphide, metal hydride.

For example, for those embodiments of the invention in which the decoy includes boron arranged to undergo thermite-type reactions initiated by the spontaneous pyrophoric combustion of ferrous oxide on exposure to air, these reactions may be represented as follows:

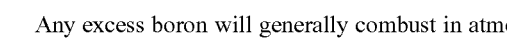

$$2B+3FeO \rightarrow B_2O_3+3Fe+Heat\ (1.93\ kJg^{-1})$$

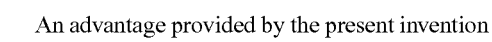

$$2B+Fe_2O_3 \rightarrow B_2O_2+3Fe+Heat\ (2.48\ kJg^{-1})$$

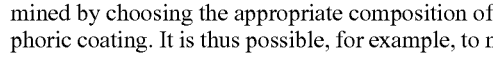

$$8B+3Fe_3O_4 \rightarrow 4B_2O_3+9Fe+Heat\ (2.23\ kJg^{-1})$$

Any excess boron will generally combust in atmospheric oxygen, generating more heat:

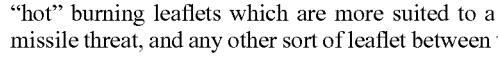

$$4B+3O_2 \rightarrow 2B_2O_3+Heat\ (58.96\ kJg^{-1})$$

An advantage provided by the present invention is that the burn time, burn temperature profile and thermal energy output of the coated substrates (leaflets) of the decoy can be determined by choosing the appropriate composition of the pyrophoric coating. It is thus possible, for example, to make relatively "cool" burning leaflets which have a thermal spectrum which is suited to decoying a certain type of missile, relatively "hot" burning leaflets which are more suited to a different missile threat, and any other sort of leaflet between these two extremes. The invention may therefore enable the thermal emission spectrum of the decoy to be chosen by varying the precise composition of the pyrophoric coating used.

As already mentioned herein, decoys according to the invention preferably contain a plurality of (e.g. several hundred) substrate pieces coated with the pyrophoric material, and preferably also coated with a binder (e.g. as described above) and/or one or more other elements and/or compounds (e.g. as described above). The containment needs to be either under a vacuum or under a substantially oxygen-free atmosphere (i.e. an inert atmosphere, e.g. of argon or nitrogen, or another inert gas or gases). This may conveniently be achieved by containing the coated substrate pieces (leaflets) in a sealed cartridge, canister, or other sealed container of the decoy, for example. As mentioned above, the decoy preferably includes means (e.g. pyrotechnic means or mechanical means) for releasing the leaflets and deploying them (e.g. dispersing them) in the air, preferably after the decoy itself has been launched.

The skilled person will realise that decoys according to the invention may take any of a wide variety of forms. For example, the decoys may be rocket propelled, may be mortar rounds or other types of rounds, or may be fired from guns or launched from other types of launchers. Also, the containment of the pyrophoric material or (when used) coated substrates in the decoy, and the deployment of the pyrophoric material or coated substrates from the decoy, may be done in any of a wide range of possible ways known to the skilled person for known decoys.

In use, the decoy is fired into the air, for example from an aircraft in flight, or from a ship or other water-based craft, or from a land-based vehicle or position. Either instantaneously or after a short delay, the coated substrate pieces (leaflets) are deployed from the decoy, e.g. by being ejected from the decoy by pyrotechnic or mechanical deployment means. On contact with the air, the pyrophoric coatings of the leaflets spontaneously ignite and combust, thereby generating heat, and any other combustible or reactive components of the coatings are initiated to react exothermically by the heat generated by the combustion of the pyrophoric material. Consequently, each leaflet generates heat and infrared radiation spontaneously upon ejection from the cartridge, and collectively the leaflets normally generate a "cloud" of hot, infrared radiation-emitting pieces carried in the air. This hot cloud provides an effective decoy to seduce, confuse or distract heat-seeking missiles or other heat-seeking devices, thereby protecting the craft, vehicle or position from which the decoy has been fired. Several, or indeed many, such decoys may be fired consecutively and/or sequentially, to generate as many such hot clouds as required to provide effective protection.

Figure 2:
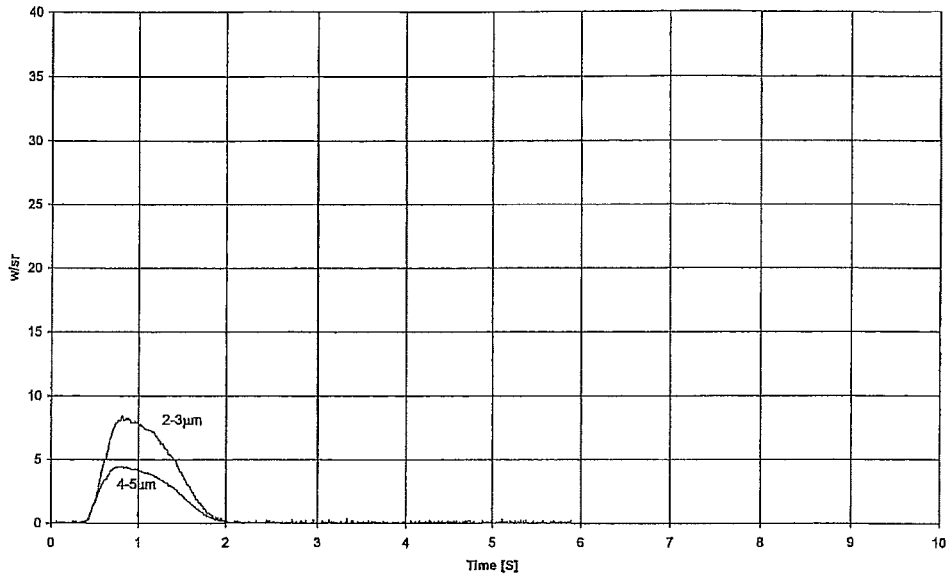
Figure 2:
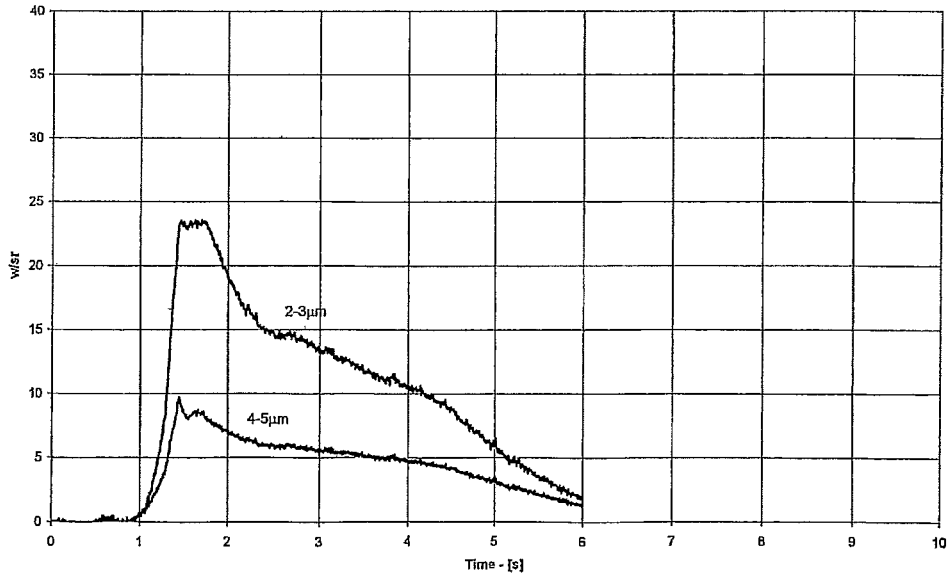
Figure 2:
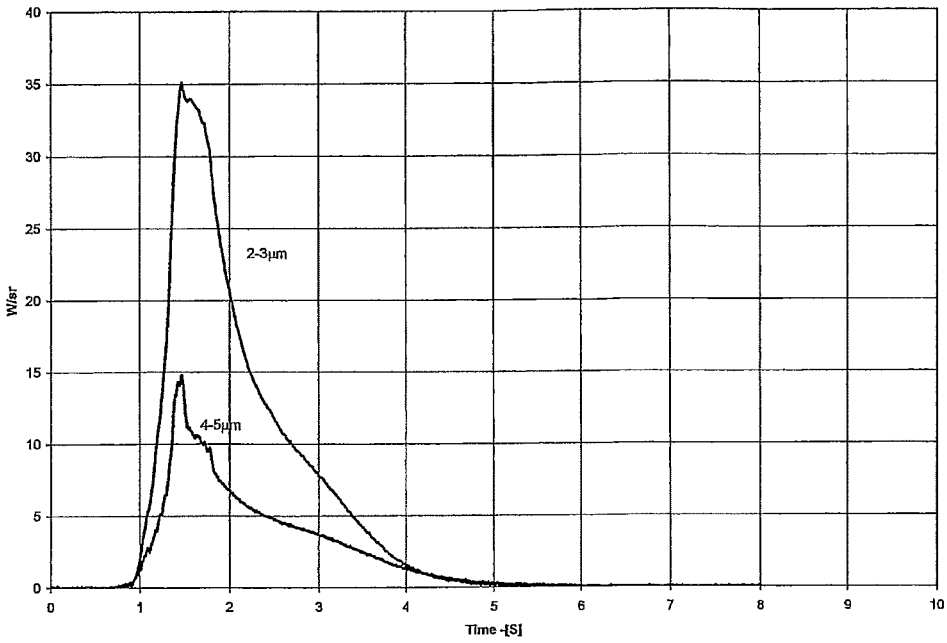
Figure 3:
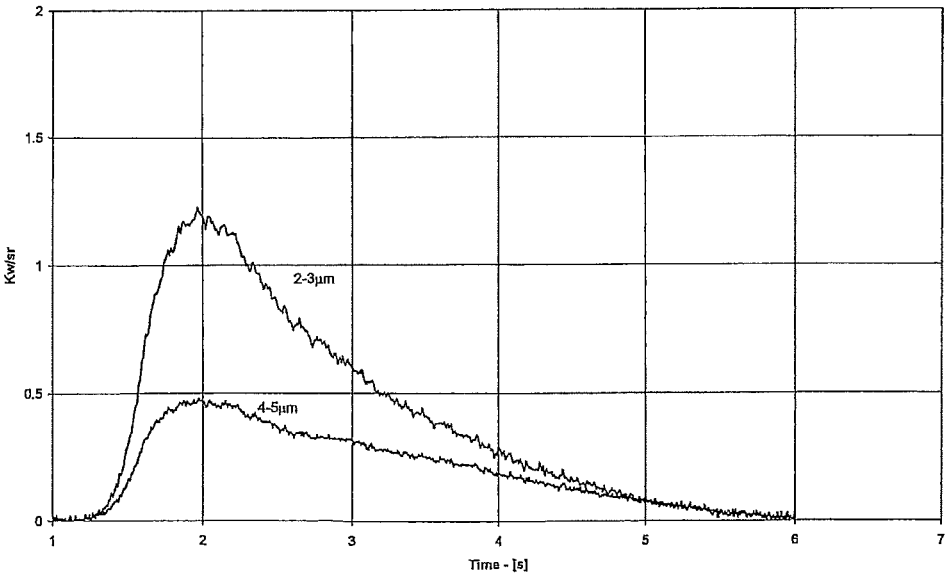

Some preferred embodiments of the invention will now be described, by way of example, with reference to the accompanying drawings, of which:

FIG. 1 is a schematic cross-sectional diagram of an example of a decoy round according to the invention;

FIG. 2 (views (a) to (c)) shows measured thermal emission profiles for three examples of pyrophoric leaflets according to the invention; and FIG. 3 shows a measured thermal emission profile for an example of a decoy as illustrated in FIG. 1, containing 900 leaflets of the composition used in FIG. 2(*b*).

FIG. 1 shows a decoy round 1 according to the invention, in the form of a sealed cartridge 3 containing a stack of a plurality (normally several hundred, e.g. 400 to 2000) of coated substrate pieces, or leaflets, 5. The leaflets 5 are coated with a pyrophoric material (e.g. ferrous oxide) in a binder (e.g. sodium silicate), and the coating may also include other components (e.g. amorphous boron and/or other components), as described above. The leaflets themselves preferably are pieces of cloth, e.g. non-woven rayon cloth, or woven cotton cloth. The leaflets 5 are contained in the sealed cartridge 3 either under a vacuum or under a substantially oxygen-free atmosphere (i.e. an inert atmosphere, e.g. of argon or nitrogen, or another inert gas or gases).

The cartridge 3 has the form of an elongate square cross-section tube, but in general it could have substantially any shape. A first end 7 of the cartridge 3 is closed by means of an end cap 11. At the opposite end 9 of the cartridge 3 is a piston 13. Adjacent to the piston 13, on the opposite side of the piston to the leaflets 5, is an ejection cartridge 15.

In use, the decoy round 1 is fired (e.g. electronically) into the air, for example from an aircraft in flight, or from a ship or other water-based craft, or from a land-based vehicle or position. Substantially instantaneously (or alternatively after a short delay) the piston 13 violently forces the piston 13 from the end 9 of the cartridge 3 to the opposite end 7 of the cartridge. This forces the end cap 11 and the leaflets 5 out of the end 7 of the cartridge, thereby ejecting the leaflets from the cartridge. Upon contact with the air, the pyrophoric coatings of the leaflets 5 spontaneously ignite and combust, thereby generating heat. Any other combustible or reactive components of the coatings, for example amorphous boron and/or any of the other possible components described above, are initiated to react exothermically by the heat generated by the combustion of the pyrophoric material. Consequently, each leaflet 5 generates heat and infrared radiation spontaneously upon ejection from the cartridge 3. Because the leaflets 5 have a low density and a relatively high surface area, because their ejection from the cartridge is violent, and due to air resistence, turbulence and wind, the leaflets 5 are somewhat dispersed from each other and generate a "cloud" of hot, infrared radiation-emitting pieces carried in the air. This hot cloud provides an effective decoy to seduce, confuse or distract heat-seeking missiles or other heat-seeking devices, thereby protecting the craft, vehicle or position from which the decoy has been fired. Several, or indeed many, such decoys may be fired consecutively and/or sequentially, to generate as many such hot clouds as required to provide effective protection.

FIG. 2 (views (a) to (c)) shows measured thermal emission profiles for three examples of pyrophoric leaflets according to the invention. In each case the y-axis of the graph denotes measurements of radiant intensity, in watts per steradian (w/sr) and the x-axis of the graph denotes elapsed time, in seconds (s).

Each leaflet was produced, and had a composition, as detailed below. In each case, the thermal emission profile of the leaflet was obtained as follows. Each single leaflet Was enclosed in a vacuum grease-sealed stoppered glass flask containing an oxygen-free argon atmosphere. The leaflet was held in place, in a substantially vertical orientation (i.e. with the plane of the substrate substantially vertical) by means of a crocodile clip attached to the glass stopper. The flask was clamped via the stopper and the leaflet was then exposed to a stream of air by manually removing the flask from the stopper. The stream of air was flowing in a downwards substantially vertical direction at a speed of 1 $ms^{-1}$. The thermal emission of the leaflet was detected by two radiometers, one detecting in the wavelength range of 2-3 μm, and the other detecting in the wavelength range of 4-5 μm.

The production and composition details of each of the three leaflets whose thermal emissions are illustrated in FIGS. 2(*a*), 2(*b*) and 2(*c*), are as follows. Each leaflet had an area of 2.5 cm×5.5 cm.

Leaflet 2(*a*):

Coating: ferrous oxalate powder (median particle size, d50<3 μm) 100% wt; mixed with an equal weight of 2.7% sodium silicate solution Substrate: 16 $gm^{-2}$ non-woven rayon cloth Dried at 100° C. in air for 15 min Cut into leaflets of area 2.5 cm×5.5 cm Decomposed in an argon atmosphere for 2 h at 400° C.

In this example, the heat generating reaction is the pyrophoric oxidation of ferrous oxide ('FeO') and the subsequent combustion of the charred substrate.

Leaflet 2(*b*):

Coating: ferrous oxalate powder (median particle size, d50<3 μm) 84.7% wt; boron (amorphous) 15.3% wt; mixed with an equal weight of 1.4% sodium silicate solution Substrate: 38 $gm^{-2}$ non-woven rayon cloth Dried at 100° C. in air for 15 min Cut into leaflets Decomposed in an argon atmosphere for 2 h at 400° C.

In this example, the initial heat generating reaction is the pyrophoric oxidation of ferrous oxide ('FeO'), which initiates a hot burning FeO/B thermite reaction. Excess boron then burns in air.

Leaflet 2(*c*):

Coating: ferrous oxalate powder (median particle size, d50<3 μm) 72% wt; titanium powder (−325 mesh) 19% wt; boron (amorphous) 9% wt; mixed with an equal weight of 2.7% sodium silicate solution Substrate: 38 $gm^{-2}$ non-woven rayon cloth Dried at 100° C. in air for 15 min Cut into leaflets Decomposed in an argon atmosphere for 2 h at 400° C.

In this example, the initial heat generating reaction is the pyrophoric oxidation of ferrous oxide ('FeO') which initiates a hot burning FeO/B thermite reaction which in turn initiates a highly exothermic alloying reaction between titanium and boron to give $TiB_2$.

FIG. 3 shows a measured thermal emission profile for an example of a decoy as illustrated in FIG. 1, containing 900 leaflets of the composition used in FIG. 2(*b*), but each having an area of 2 cm×2 cm (rather than 2.5 cm×5.5 cm). The decoy cartridge was fired in still air conditions, and the thermal output was measured by two radiometers, one detecting in the wavelength range of 2-3 μm, and the other detecting in the wavelength range of 4-5 μm. The y-axis of the graph denotes measurements of radiant intensity, in kilowatts per steradian (kw/sr) and the x-axis of the graph denotes elapsed time, in seconds (s).

The skilled person will understand that many other types and designs of decoy may be used in accordance with the present invention. Decoys according to the invention may, for example, be rocket propelled, may be mortar rounds or other types of rounds, or may be fired from guns or launched from other types of launchers. Also, the containment of the pyrophoric material(s) or (when used) coated substrates in the decoy, and the deployment of the pyrophoric material(s) or coated substrates from the decoy, may be done in any of a wide range of possible ways known to the skilled person for known decoys.

The invention claimed is:

1. A process of producing an infrared radiation-generating decoy, comprising the steps of:

decomposing a metal carboxylate in the substantial absence of gaseous oxygen, to produce a pyrophoric material as a decomposition product of the metal carboxylate, wherein the pyrophoric material is arranged to combust spontaneously upon contact with air when the decoy is used and wherein the pyrophoric material is coated on a woven or unwoven cloth substrate which is substantially entirely combustible on deployment of the decoy; and cutting the cloth substrate into a plurality of leaflets, wherein the pyrophoric material is coated on the substrate by coating the metal carboxylate on the substrate and then decomposing the metal carboxylate to form the pyrophoric material as a coating on the substrate, wherein the metal carboxylate is coated on the substrate in particulate form and has a median particle size of less than 20 μm, and wherein a weight of the cloth is no more than 60 $gm^{-2}$.

2. The process according to claim 1, wherein the step of decomposing the metal carboxylate comprises thermally decomposing the metal carboxylate.

3. The process according to claim 2, further comprising the step of carrying out the thermal decomposition at a temperature greater than 200° C.

4. The process according to claim 1, wherein the metal comprises iron.

5. The process according to claim 1, wherein the carboxylate comprises one or both of oxalate or fumarate.

6. The process according to claim 1, wherein the pyrophoric material comprises an oxide of the metal.

7. The process according to claim 6, wherein the pyrophoric material comprises ferrous oxide (Fe(II)O).

8. The process according to claim 1, further comprising the step of painting the coating on the cloth substrate.

9. The process according to claim 1, wherein the coating is dried prior to the decomposing step.

10. The process according to claim 1, wherein the decoy includes a container, and the process further comprises the steps of packing the plurality of leaflets into the container in the substantial absence of gaseous oxygen to form a stack of leaflets in the container, and then sealing the container against the ingress of gaseous oxygen.

11. The process according to claim 1, wherein the cloth substrate comprises rayon/viscose cloth, carbon cloth or cotton.

12. The process according to claim 1, wherein the coating includes a binder.

13. The process according to claim 12, wherein the binder comprises a silicate, a phosphate, or a clay.

14. The process according to claim 13, wherein the binder comprises sodium silicate.

15. The process according to claim 1, wherein the weight of the cloth is in the range of 15-60$gm^{-2}$.

16. The process according to claim 1, wherein the weight of the cloth is no more than 45$gm^{-2}$.

17. The process according to claim 16, wherein the weight of the cloth is in the range of 20-45$gm^{-2}$.

18. The process according to claim 1, wherein the metal carboxylate has a median particle size of less than 5 μm.

* * * * *